US005703475A

United States Patent [19]

Lee et al.

[11] Patent Number: 5,703,475

[45] Date of Patent: Dec. 30, 1997

[54] REFERENCE VOLTAGE GENERATOR WITH FAST START-UP AND LOW STAND-BY POWER

[75] Inventors: Kyu-Chan Lee, Seoul; Jai-Hoon Sim, Kyungki-do, both of Rep. of Korea

[73] Assignee: Samsung Electronics Co., Ltd., Suwon, Rep. of Korea

[21] Appl. No.: 671,145

[22] Filed: Jun. 24, 1996

[30] Foreign Application Priority Data

Jun. 24, 1995 [KR] Rep. of Korea ..... 1995 17364

[51] Int. Cl.[6] ..... G05F 3/16

[52] U.S. Cl. ..... 323/313; 327/538

[58] Field of Search ..... 323/312, 313; 327/538, 539, 540, 541, 544

[56] References Cited

U.S. PATENT DOCUMENTS 4,342,926 8/1982 Whatley ..... 327/541
5,109,187 4/1992 Guliani ..... 323/313
5,404,096 4/1995 Thiel ..... 323/312
5,453,679 9/1995 Rapp ..... 323/313

OTHER PUBLICATIONS

Y. Nakagome et al., "A 1.5V Circuit Technology for 64 Mb DRAMS," 1990 Symposium on VLSI Circuits, pp. 17–18.

*Primary Examiner*—Matthew V. Nguyen
*Attorney, Agent, or Firm*—Marger, Johnson, McCollom & Stolowitz, P.C.

[57] ABSTRACT

A reference voltage generator includes a pull-up stage which pulls a reference voltage signal rapidly up toward ½Vcc at power-up. The pull-up stage is controlled by a controller which has a comparator and control voltage generator which are disabled after the pull-up operation is terminated so as to reduce stand-by current consumption. The controller includes a pair of NAND gates cross connected as an RS flip-flop to turn on the pull-up stage at power up. A boost signal allows the flip-flop to enable the comparator and control voltage generator after the power supply has stabilized. When the reference voltage signal reaches ½Vcc, the comparator sets the flip flop which turns off the pull-up stage and disables the comparator and control voltage generator.

19 Claims, 3 Drawing Sheets

REFERENCE VOLTAGE GENERATOR WITH FAST START-UP AND LOW STAND-BY POWER

BACKGROUND OF THE INVENTION

1. Field of the Invention

This invention relates generally to reference voltage generators and more particularly to reference voltage generators with fast start-up characteristics and low stand-by power consumption.

The present application is based on Korean Application No. 17364/11995 which is incorporated herein by reference for all purposes.

2. Description of the Related Art

As the density of semiconductor memory devices increases, the sizes of the transistors used in the devices become smaller and oxide films used in the transistors become thinner. Generally, semiconductor memory devices must be operated at lower voltages in order to increase the density of memory cells. For example, 4 megabit (Mb) dynamic ram chips (DRAM) typically operate at 5 volts, 16b Mb DRAM chips operate at 3 volts, and 64 Mb DRAM chips typically operate at 2 volts.

FIG. 1 shows a prior art reference voltage generator (RVG) for a semiconductor memory device, which is comprised of a voltage dividing bias stage 10 and a push-pull output stage 20. The voltage dividing bias stage 10 is constructed with a resistor 12 having one node connected to a first power supply voltage Vcc, an NMOS transistor 14 having a drain and a gate, both of which are connected to the other node of the resistor 12 thereby forming a diode, a PMOS transistor 16 and a resistor 18, both of which are serially connected between the source of the NMOS transistor 14 and a second power supply voltage Vss thereby forming a diode.

The push-pull output stage 20 of FIG. 1 includes an NMOS transistor 22 which has a drain connected to the first power supply voltage Vcc, a gate connected to a node N1 where the resistor 12 and the drain of the NMOS transistor 14 are connected to each other, and a source connected to a node N4. The push-pull stage also includes a PMOS transistor 24 which has a source connected to the node N4, a drain connected to the second power supply voltage Vss, and a gate connected to a node N3 where the resistor 18 and the drain of the PMOS transistor 16 are connected to each other.

When a power supply voltage Vcc of 3 volts is applied to the voltage generator of FIG. 1, the components connected in series with one another between the first power supply voltage Vcc and the second power supply voltage Vss (resistor 12, NMOS transistor 14, PMOS transistor 16 and resistor 18) divide the first power supply voltage Vcc and generate bias voltages at the gates of NMOS transistor 22 and PMOS transistor 24, so that transistors 22 and 24 begin executing a push-pull operation for generating a reference voltage. More specifically, when the power is supplied a voltage V1 of $0.5Vcc+Vtn_{14}$ is set up between the drain and the gate of transistor 14, a voltage V2 of 0.5Vcc is set up between the gate and the source of transistor 16, a voltage V3 of $0.5Vcc-Vtp_{24}$ is set up between the gate and the drain of transistor 24, and the voltage V4 at the node N4 is initially at zero volts. (Vtn is the threshold voltage of an NMOS transistor, Vtp is designated as a threshold voltage of a PMOS transistor, and the respective subscripts of the above symbols are the corresponding reference numerals of the above transistors.)

As transistor 22 turns on it will supply a drain current ID at node N4 given by:

$$ID = 1/2\beta n2(V1 - V4 - Vtn_{24})^2$$
$$= 1/2\beta n2(0.5Vcc - V4)^2$$

where βn2 is Wn/Ln·Cox·μeff, Wn is the channel width and Ln is the channel length. The voltage of the node N4 is driven by the current ID as explained above until the voltage of the node N4 rises to one-half of the power supply voltage.

Once the voltage at node N4 exceeds ½Vcc, transistor 24 turns on, and the output voltage level stabilizes at ½Vcc due to the push-pull operation of transistors 22 and 24.

However, the prior art reference voltage generator of FIG. 1 has poor response speed and low current drive capability. Another problem with the generator of FIG. 1 is that it takes a long time to establish the ½Vcc reference voltage at node N4 after power-up.

FIG. 2 is a diagram illustrating another prior art reference voltage generator for use is semiconductor memory devices. The circuit of FIG. 2 includes a voltage dividing bias stage 11 which improves upon the bias stage 10 of FIG. 1. The bias stage 11 as shown in FIG. 2 includes a PMOS transistor 13 connected between the drain of NMOS transistor 14 and the first power supply voltage Vcc, and an NMOS transistor 17 connected between the second power supply voltage Vss and the drain of PMOS transistor 16. Here, both channels of the above transistors are controlled by the voltage level of node N4.

Although the reference voltage generator of FIG. 2 has improved performance over the circuit of FIG. 1, it still has poor response speed and takes a long time to establish the reference voltage after power-up.

The circuit published by Y. Nakagome, et al. in a paper entitled "A 1.5V Circuit Technology for 64Mb DRAM", on pages 17 to 18 of the publication "1990 Symposium on VLSI Circuits" is one example of a reference voltage generator that is designed to address the problems of the reference voltage generators as set forth in FIGS. 1 and 2. The reference voltage generator disclosed by Y. Nakagome, et al. is provided with a current minor amplifier and a tri-state buffer which improves the response speed. However, the reference voltage generator disclosed by Y. Nakagome, et al. does not improve the power-on, and the tri-state buffer introduces several additional problems. First, because a direct current flows in the tri-state buffer, the semiconductor memory device consumes high stand-by current. Second, since the stand-by current of the tri-state buffer is susceptible to process variations in the semiconductor memory device, the yield of the manufacturing process deteriorates accordingly.

Accordingly, a need remains for a reference voltage generator which overcomes the problems discussed above.

SUMMARY OF THE INVENTION

It is, therefore, an object of the invention to provide a reference voltage signal which has a high response speed and a short power-up delay.

Another object of the invention is to provide a reference voltage generator which has low current consumption in stand-by mode.

One aspect of the present invention is a reference voltage generator comprising: a reference stage which generates a reference voltage signal; a controller coupled to the reference stage to receive the reference voltage signal, the controller generating a control signal responsive to the reference voltage signal; and a pull-up stage coupled to the controller to receive the control signal and coupled to the reference stage to pull up the reference voltage signal responsive to the control signal.

The controller generates the control signal when power is applied to the reference voltage generator and stops generating the control signal when the reference voltage signal reaches a predetermined voltage. The controller includes a control voltage generator which generates a control voltage signal and a comparator coupled to the control voltage generator, the comparator generating an output signal responsive to the difference between the reference voltage signal and the control voltage signal. The controller further includes: a latch coupled to the comparator for latching the output signal from the comparator, thereby generating a level detection signal; and a flip-flop coupled to the latch, the flip-flop generating the control signal responsive to the level detection signal. A flip-flop disables the comparator and control voltage generator responsive to the output signal from the comparator and enables the comparator and control voltage generator responsive to a boost signal.

Another aspect of the present invention is a method for generating a reference voltage signal comprising: applying power to a reference generator, thereby generating a reference voltage signal; generating a control signal when the power is applied; pulling up the reference voltage signal responsive to the control signal; and stopping generating the control signal when the reference voltage signal reaches a predetermined voltage. The method further includes enabling a control voltage generator when the power is applied, thereby generating a control voltage signal; and comparing the control voltage signal to the reference voltage signal. The method also includes disabling the control voltage generator when the voltage of the reference voltage signal equals the voltage of the control voltage signal.

The foregoing and other objects, features and advantages of the invention will become more readily apparent from the following detailed description of a preferred embodiment of the invention which proceeds with reference to the accompanying drawings.

DETAILED DESCRIPTION OF THE PREFERRED EMBODIMENT

Figure 3:
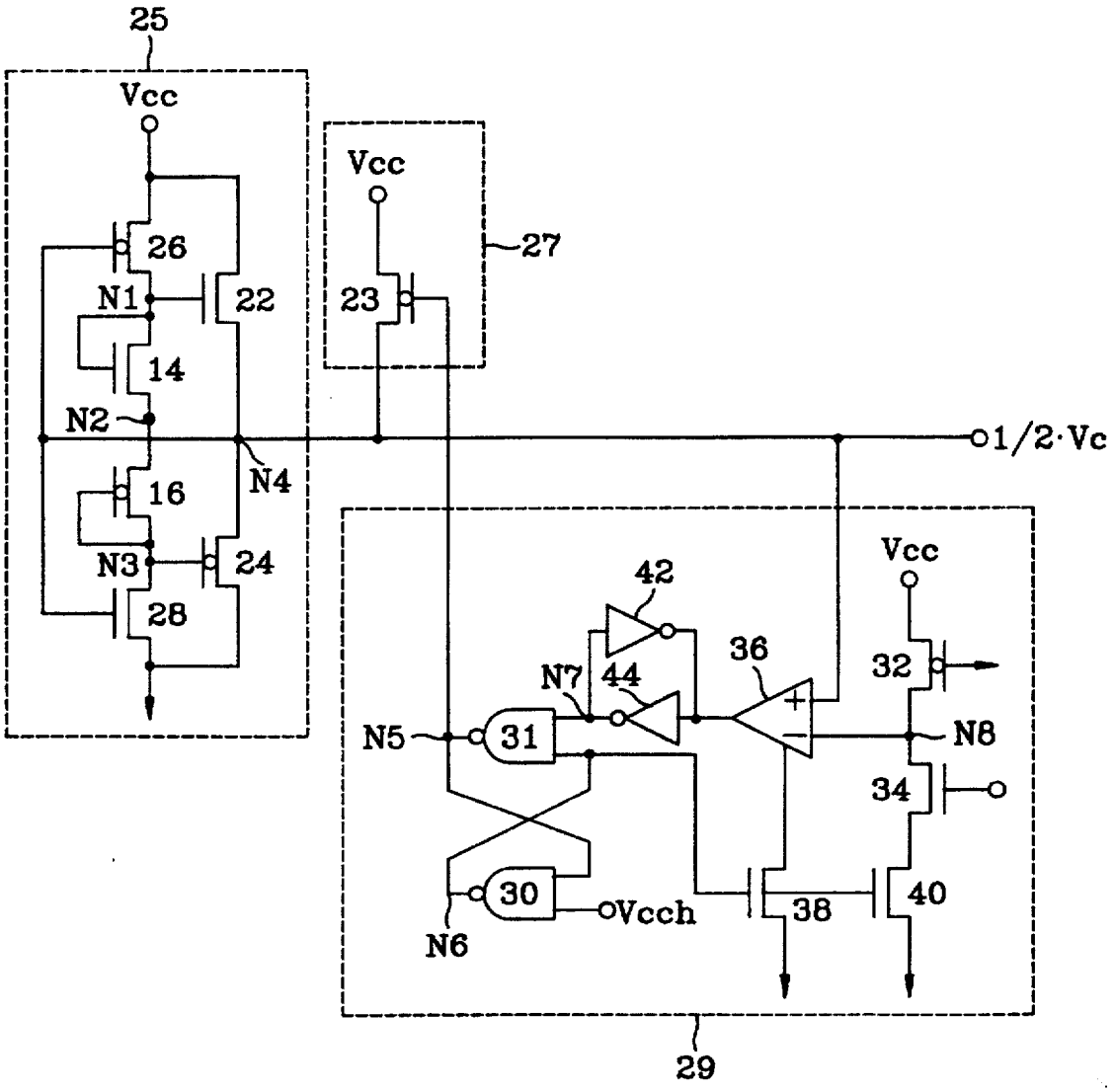
FIG. 3 is a schematic diagram of an embodiment of a reference voltage generator in accordance with the present invention.

An embodiment of a reference voltage generator in accordance with the present invention is shown in FIG. 3. Prior to describing the detailed structure of the reference voltage generator, the key components of the invention will he identified followed by a brief description of the operation of the system. Then a more detailed description of each of the components will he provided along with a more detailed description of the operation.

Referring to FIG. 3, a reference voltage generator in accordance with the present invention includes a conventional reference voltage generator stage 25 (reference stage), a pull-up stage 27, and a controller 29. The reference stage generates a ½Vcc reference voltage signal at reference node N4 by dividing the power supply signal Vcc. At power-up, the pull-up stage 27 pulls the reference voltage signal rapidly toward Vcc, thus reducing the amount of time the reference generator requires to reach ½Vcc.

The pull-up stage 27 is controlled by the controller 29 which generates a control signal at control node N5. The controller 29 includes a control voltage generator formed by transistors 32 and 34 which generates a control voltage signal at node N8. Controller 29 also includes a comparator 36 and an RS flip-flop formed by NAND gates 30 and 31. The comparator 36 and control voltage generator can be enabled or disabled by switching transistors 38 and 40 which are connected to the flip-flop.

At power-up, the control signal at N5 is initially at a low logic level which turns the pull-up stage 27 on, thereby pulling up the voltage at N4. Comparator 36 compares the voltage at N4 to the control voltage signal at N8. When the voltage at N4 reaches the voltage at N8, the comparator sets the flip-flop which drives N5 to a high logic level, thereby turning off the pull-up stage 27. When the flip-flop is set, switching transistors 38 and 40 are also turned off, thereby disabling the comparator 36 and control voltage generator and reducing power consumption in stand-by mode.

Figure 1:
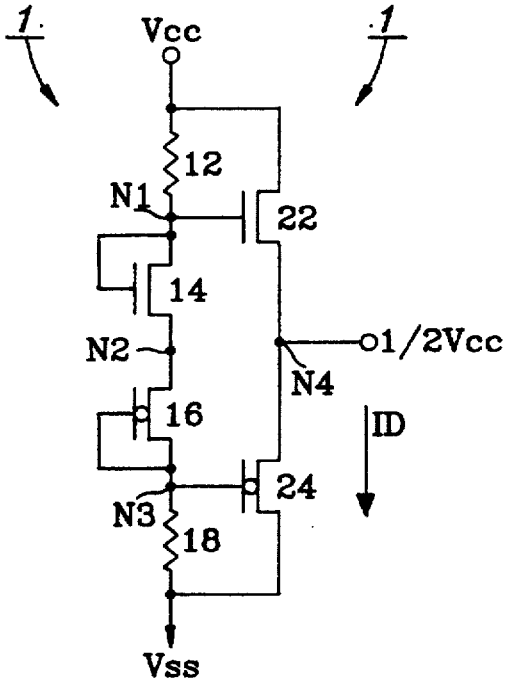
(PRIOR ART) Fig. 1
FIG. 1 is a schematic diagram of a prior art reference voltage generator.
Figure 2:
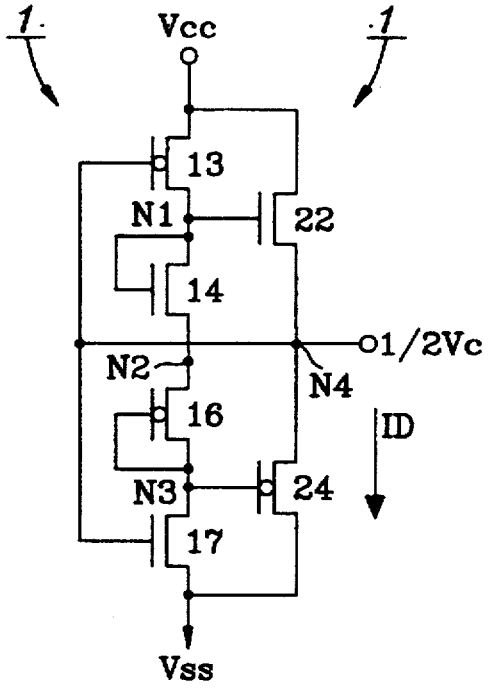
(PRIOR ART) Fig. 2
FIG. 2 is a schematic diagram of a prior art reference voltage generator having a voltage bias stage.
Figure 5:
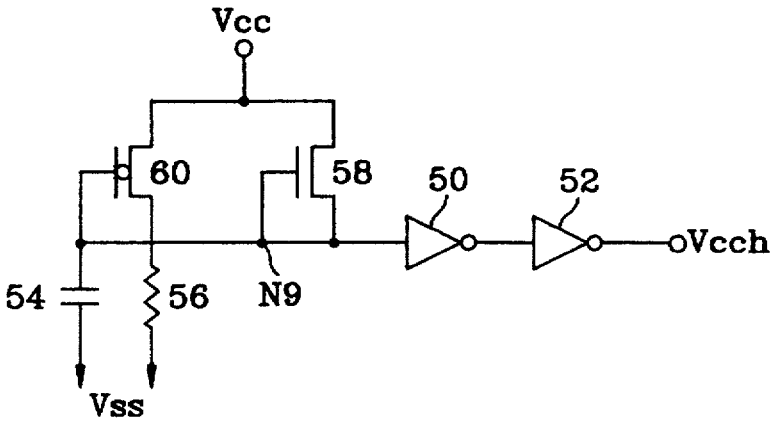
FIG. 5 is a schematic diagram of an embodiment of a boost signal generator in accordance with the present invention.

The controller 29 also has a boost voltage node which receives a boost signal Vcch from a boost voltage circuit shown in FIG. 5. At power up, the boost signal is initially at a low logic level which holds node N6 low, which in turn keeps transistors 38 and 40 off and disables the comparator and control voltage generator. When the power supply signal Vcc reaches its full operating level, the boost signal Vcch goes high and transistors 38 and 40 turn on. Thus, the comparator and control voltage generator are disabled until the power supply has reached the full operating level.

More detailed consideration will now be given to the structure and operation of the present invention. Referring to FIG. 3, a reference voltage generator in accordance with the present invention includes a conventional reference voltage generator stage 25 (reference stage) which is connected between a first power supply node and a second power supply node (Vss). The reference stage 25 includes a voltage bias stage and a push pull output stage and generates a ½Vcc reference voltage signal at reference node N4 by dividing the power supply signal Vcc.

Figure 4:
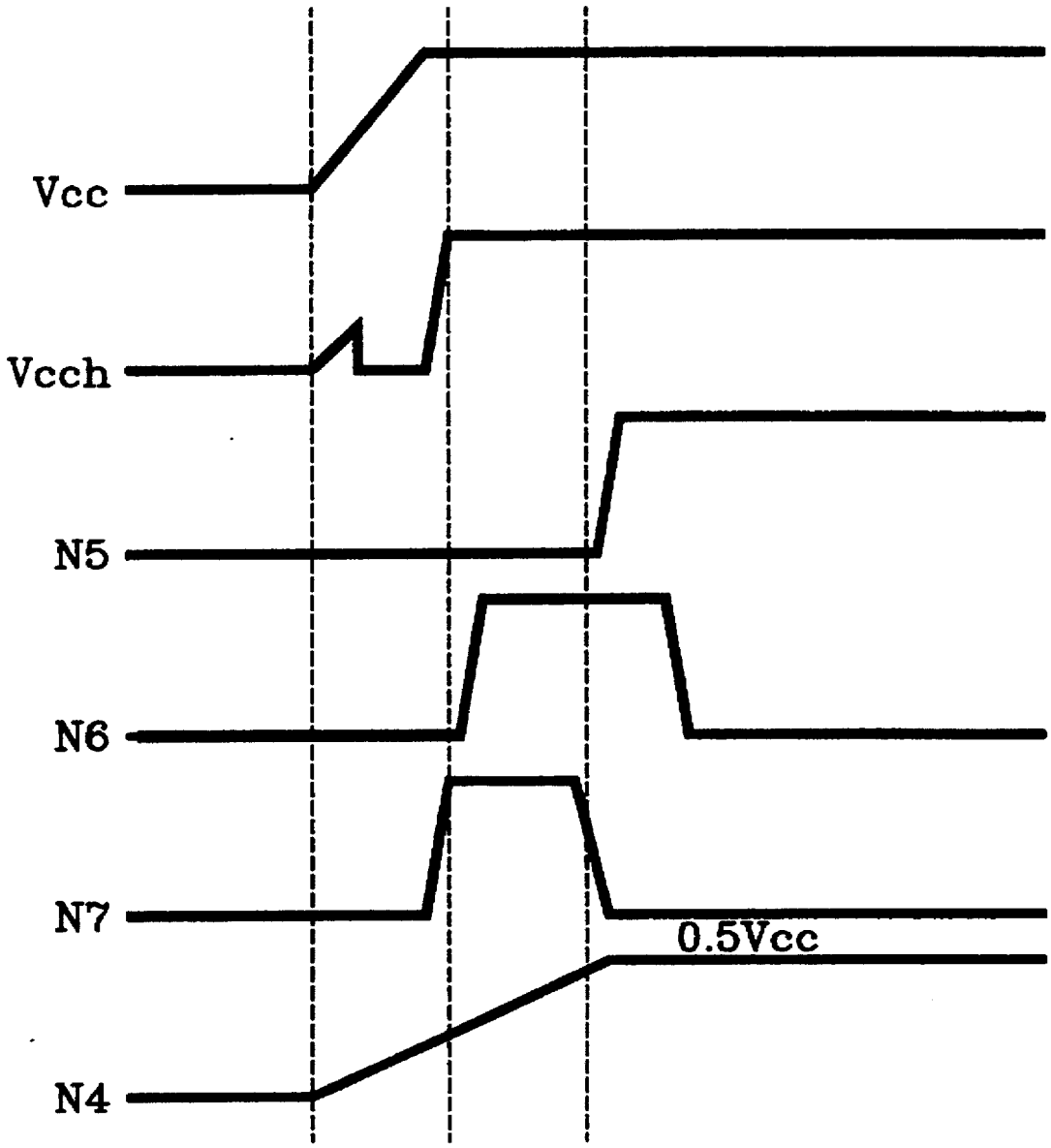
FIG. 4 is a graph of voltage signal waveforms at various nodes of the voltage reference generator of FIG. 3.

The pull-up stage 27 includes a PMOS pull-up transistor 23 having a source connected to the first power supply node and a drain connected to the reference node N4. The gate of transistor 23 is connected to the control node NS. When the control signal at node N5 is at a low logic level, transistor 23 is gated on and pulls the reference voltage signal at N4 rapidly up towards ½Vcc as shown in FIG. 4.

The controller 29 includes a control voltage generator which preferably includes a PMOS transistor 32 with its source connected to Vet and its gate connected to Vss. The drain of transistor 32 is connected to a control voltage node N8. The control voltage generator also preferably includes an NMOS transistor 34 having a drain connected to node N8 and a gate connected to Vcc. The source of transistor 34 is connected to the drain of an NMOS switching transistor 40 which has its source connected to Vss.

When transistor 40 is in a conductive state, transistors 32 and 34 divide the supply voltage signal Vcc and a control voltage signal is generated at control voltage node N8. The voltage at N8 is determined by the resistance ratio of the channel length to channel width of transistors 32 and 34. When switching transistor 40 is cut off, the control voltage generator is disabled, thereby reducing power consumption.

Although the control voltage generator is preferably implemented with transistors 32 and 34, it could also by implemented using only resistors.

The controller 29 also includes a comparator 36 which has an inverting input terminal connected to the control voltage node N8 and a noninverting input terminal connected to the reference node N4. The comparator also has a current sink terminal which is connected to the drain of an NMOS switching transistor 38. The source of transistor 38 is connected to Vss. When switching transistor 38 is in a conductive state, the comparator is enabled and generates an output signal at its output terminal based on the respective voltages at N8 and N4. When transistor 38 is cut off, the comparator is disabled, thereby reducing power consumption.

The output of comparator 36 is connected to the input terminal of an inverter 44. The output terminal of inverter 44 is connected to a level detection node N7. A second inverter 42 is connected in antiparallel across inverter 44 with the input of inverter 42 connected to the output of inverter 44 and the output of inverter 42 connected to the input of inverter 44. Thus, inverters 42 and 44 form an inverting latch which latches the output signal from comparator 36 thereby generating a level detection maintaining signal (level detection signal) at node N7.

Controller 29 further includes a pair of NAND gates 30 and 31 which are cross connected to form an RS flip-flop. One input terminal of NAND gate 31 is connected to node N7, while the other input terminal of gate 31 is connected to the output terminal of NAND gate 30. The output terminal of gate 31 is connected to the control node N5. One input terminal of NAND gate 30 is connected to the output terminal of gate 31, while the other input terminal of gate 30 is connected to a boost voltage node which receives the boost signal Vcch. The output terminal of gate 30 is also connected to the gates of both switching transistors 38 and 40. The flip-flop is constructed so that node N5 is at a logic low level at power-up.

The boost signal Vcch is generated by a boost voltage circuit shown in FIG. 5. The boost voltage circuit includes a PMOS transistor 60 having a source terminal connected to Vcc and a drain connected to Vss through a resistor 56. The gate of transistor 60 is connected to Vss through a capacitor 54. The gate of transistor 60 is also connected to the gate and source of an NMOS transistor 58 and the input terminal of an inverter 50 at node N9. The drain of transistor 58 is connected to Vcc and the output terminal of inverter 50 is connected to the input terminal of another inverter 52 which has an output terminal connected to the boost voltage node.

When power is initially applied to the reference voltage generator of the present invention, the power supply signal Vcc begins rising as shown in FIG. 4. At power up, the control signal at control node N5 is at a low logic level, so the pull-up stage 27 is turned on and pulls the reference voltage signal at reference node N4 rapidly up towards ½Vcc as shown in FIG. 4. Thus, the time required to bring the reference voltage signal up to the operating value is reduced.

The boost signal Vcch is initially at a low logic level at power-up, thus the voltage at node N6 is low and transistors 38 and 40 disable the comparator 36 and the control voltage generator. When the power supply signal Vcc is applied to the boost voltage circuit of FIG. 5, the voltage at N9 increases due to repetitive pumping, and the boost signal Vcch at the boost node reaches Vcc shortly after the power supply signal Vcc reaches its normal operating level.

When Vcch switches to the logic high level, the voltage at node N6 goes high as shown in FIG. 4 and switches on transistors 38 and 40, thereby enabling the comparator 36 and the control voltage generator. The comparator begins comparing the voltage of the reference voltage signal at N4 to the voltage of the control voltage signal at N8. When the reference voltage reaches the control voltage, the comparator output switches from low to high which sets the flip-flop causing the control signal at control node N5 to go high and the voltage at node N6 to go low as shown in FIG. 4.

The low-to-high transition at N5 switches off the pull-up stage 27 and the pull-up operation is terminated. The reference voltage signal is then maintained by the reference stage 25. The high-to-low transition at N6 also switches off transistors 38 and 40 which disables the comparator and control voltage generator, thereby reducing current consumption in stand-by mode.

Having described and illustrated the principles of the invention in a preferred embodiment thereof, it should he apparent that the invention can he modified in arrangement and detail without departing from such principles. I claim all modifications and variation coming within the spirit and scope of the following claims.

We claim:

1. A reference voltage generator comprising:

a reference stage which generates a reference voltage signal;

a controller coupled to the reference stage to receive the reference voltage signal, the controller generating a control signal responsive to the reference voltage signal; and a pull-up stage coupled to the controller to receive the control signal and coupled to the reference stage to pull up the reference voltage signal responsive to the control signal, the pull-up stage being capable of being switched off during normal operation;

wherein the controller switches the pull-up stage off when the reference signal reaches a predetermined voltage.

2. A reference voltage generator according to claim 1 wherein the controller switches the pull-up stage on when power is applied to the reference voltage generator.

3. A reference voltage generator according to claim 1 wherein the controller includes a control voltage generator which generates a control voltage signal and a comparator coupled to the control voltage generator, the comparator generating an output signal responsive to the difference between the reference voltage signal and the control voltage signal.

4. A reference voltage generator 3 wherein the comprising:

a reference stage which generates a reference voltage signal:

a controller coupled to the reference stage to receive the reference voltage signal, the controller generating a control signal responsive to the reference voltage signal; and a pull-up stage coupled to the controller to receive the control signal and coupled to the reference stage to pull up the reference voltage signal responsive to the control signal:

wherein the controller includes:

a control voltage generator which generates a control voltage signal:

a comparator coupled to the control voltage generator the comparator generating an output signal responsive to the difference between the reference voltage signal and the control voltage signal:

a latch coupled to the comparator for latching the output signal from the comparator, thereby generating a level detection signal; and a flip-flop coupled to the latch, the flip-flop generating the control signal responsive to the level detection signal.

5. A reference voltage generator comprising:

a reference stage which generates a reference voltage signal;

a controller coupled to the reference stage to receive the reference voltage signal, the controller generating a control signal responsive to the reference voltage signal: and a pull-up stage coupled to the controller to receive the control signal and coupled to the reference stage to pull up the reference voltage signal responsive to the control signal;

wherein the controller includes:

a control voltage generator which generates a control voltage signal;

a comparator coupled to the control voltage generator the comparator generating an output signal responsive to the difference between the reference voltage signal and the control voltage signal; and a flip-flop which disables the comparator and control voltage generator responsive to the output signal from the comparator.

6. A reference voltage generator according to claim 5 wherein the flip-flop enables the comparator and control voltage generator responsive to a boost signal.

7. A reference voltage generator according to claim 1 further including a first power supply node, a second power supply node, a reference node, and a control node, the reference stage generating the reference voltage signal at the reference node, the controller generating the control signal at the control node.

8. A reference voltage generator 7 comprising:

a reference stage which generates a reference voltage signal:

a controller coupled to the reference stage to receive the reference voltage signal the controller generating a control signal responsive to the reference voltage signal:

a pull-up stage coupled to the controller to receive the control signal and coupled to the reference stage to pull up the reference voltage signal responsive to the control signal:

a first power supply node:

a second power supply node;

a reference node: and wherein the reference stage generates the reference voltage signal at the reference node, and the controller generates the control signal at the control node, and wherein the pull-up stage includes a transistor having a source coupled to the first power supply node, a drain coupled to the reference node, and a gate coupled to the control node, whereby the transistor pulls up the reference voltage signal responsive to the control signal at the control node.

9. A reference voltage generator 7 comprising:

a reference stage which generates a reference voltage signal;

a controller coupled to the reference stage to receive the reference voltage signal, the controller generating a control signal responsive to the reference voltage signal;

a pull-up stage coupled to the controller to receive the control signal and coupled to the reference stage to pull up the reference voltage signal responsive to the control signal;

a first power supply node;

a second power supply node:

a reference node: and a control node:

wherein the reference stage generates the reference voltage signal at the reference node, and the controller generates the control signal at the control node; and wherein the controller includes a control voltage generator including a first transistor having a source coupled to the first power supply node, a drain coupled to a control voltage node, and a gate coupled to the second power supply node, and a second transistor having a source coupled to the second power supply node, a drain coupled to the control voltage node, and a gate coupled to the first power supply node.

10. A reference voltage generator according to claim 9 wherein the controller further includes a comparator having a first input terminal coupled to the reference node, a second input terminal coupled to the control voltage node, and an output terminal coupled to the control node.

11. A reference voltage generator according to claim 10 wherein the controller further includes a latch including a fast inverter having an input terminal coupled to the output terminal of the comparator and an output terminal coupled to a level detection node, and a second inverter having an output terminal coupled to the input terminal of the first inverter and an output terminal coupled to the input terminal of the first inverter.

12. A reference voltage generator according to claim 11 wherein the controller further includes a flip-flop including a first NAND gate having a first input terminal coupled to the level detection node, a second input terminal coupled to an output terminal of a second NAND gate, and an output terminal coupled to the control node, the second NAND gate having a first input terminal coupled to a boost voltage node and a second input terminal coupled to the control node.

13. A reference voltage generator according to claim 12 wherein the comparator has a sink current terminal and the controller further includes a fast switching transistor having a source coupled to the second power supply node, a drain coupled to the sink current terminal, and a gate coupled to the output terminal of the second NAND gate, and a second switching transistor having a source coupled to the second power supply node, a drain coupled to the source of the second transistor of the control voltage generator, and a gate coupled to the output terminal of the second NAND gate.

14. A reference voltage generator according to claim 12 further including a boost voltage circuit including:

a first transistor having a source coupled to the first power supply node, a drain coupled to the second power supply node through a resistor, and a gate coupled to the second power supply node through a capacitor;

a second transistor having a drain coupled to the fast power supply node, a source coupled to the gate of the fast transistor, and a gate coupled to the gate of the first transistor;

a first inverter having an input terminal coupled to the source of the second transistor; and a second inverter having an input terminal coupled to the output terminal of the first inverter and an output terminal coupled to the boost voltage node.

15. A reference voltage generator comprising:

means for generating a reference voltage signal;

means for generating a control signal responsive to the reference voltage signal; and means for pulling up the reference voltage signal responsive to the control signal, said means being capable of being switched off during normal operation:

wherein the means for generating a control signal switches off the means for pulling up the reference voltage sisal when the reference voltage signal reaches a predetermined voltage.

16. A reference voltage generator according to claim 15, wherein the means for generating a control signal can be disabled responsive to a boost signal.

17. A method for generating a reference voltage signal comprising:

applying power to a reference generator, thereby generating a reference voltage signal;

switching on a pull-up stage coupled to the reference generator when the power is applied, thereby pulling up the reference voltage signal; and switching off the pull-up stage when the reference voltage signal reaches a predetermined voltage.

18. A method according to claim 17 further including:

enabling a control voltage generator when the power is applied, thereby generating a control voltage signal; and comparing the control voltage signal to the reference voltage signal.

19. A method according to claim 18 further including disabling the control voltage generator when the voltage of the reference voltage signal equals the voltage of the control voltage signal.

* * * * *

UNITED STATES PATENT AND TRADEMARK OFFICE

CERTIFICATE OF CORRECTION

PATENT NO. : 5,703,475
DATED : December 30, 1997
INVENTOR(S) : Kyu-Chan Lee, et al.

It is certified that error appears in the above-identified patent and that said Letters Patent is hereby corrected as shown below:

Column 1,
Line 13, “11995” should read -- 1995 --;

Column 2,
Line 21, “For use is” should read -- For use in --;
Line 42, “minor” should read -- mirror --;

Column 4,
Line 59, “Vet” should read -- Vcc --;

Column 5,
Line 7, “by” should read -- be --;

Column 6,
Line 55, “generator 3 wherein the” should read -- generator comprising --;

Column 7,
Line 58, “and wherein the” should read -- and a control node --;

Column 8,
Line 50, “includes a fast” should read -- includes a first --;

Column 9,
Line 16, “voltage sisnal” should read -- voltage signal --.

Signed and Sealed this

Twenty-fifth Day of February, 2003

JAMES E. ROGAN
*Director of the United States Patent and Trademark Office*